US007332033B2

(12) United States Patent
Henninger et al.

(10) Patent No.: US 7,332,033 B2
(45) Date of Patent: Feb. 19, 2008

(54) DOCTOR BED

(75) Inventors: Christoph Henninger, Heidenheim (DE); Horst Kaipf, Lauingen (DE); Martin Schaubmaier, Rohrbach (AT); Michael Heitzinger, Linz (AT); Ruediger Keinberger, Aigen (AT)

(73) Assignee: Voith Paper Patent GmbH, Heidenheim (DE)

( * ) Notice: Subject to any disclaimer, the term of this patent is extended or adjusted under 35 U.S.C. 154(b) by 241 days.

(21) Appl. No.: 11/147,118

(22) Filed: Jun. 7, 2005

(65) Prior Publication Data

US 2005/0284363 A1 Dec. 29, 2005

(30) Foreign Application Priority Data

Jun. 16, 2004 (DE) ..... 10 2004 028 754

(51) Int. Cl.
*B05C 1/08* (2006.01)

(52) U.S. Cl. ..... 118/118; 118/119; 118/126; 118/258; 118/414; 101/363; 15/256.51; 15/256.52; 162/281

(58) Field of Classification Search ..... 118/410, 118/118, 119, 126, 258, 413, 414; 101/363, 101/425; 15/256.51, 256.52; 162/281
See application file for complete search history.

(56) References Cited

U.S. PATENT DOCUMENTS

| | | | | |
|---|---|---|---|---|
| 2,861,541 A | | 11/1958 | Hornbostel | 118/119 |
| 3,896,036 A | * | 7/1975 | Cairns | 508/104 |
| 4,241,691 A | * | 12/1980 | Hopfe et al. | 118/126 |
| 6,019,846 A | | 2/2000 | Graf et al. | 118/414 |

FOREIGN PATENT DOCUMENTS

WO WO 97/04172 2/1997

* cited by examiner

*Primary Examiner*—Laura Edwards
(74) *Attorney, Agent, or Firm*—Taylor & Aust, P.C.

(57) ABSTRACT

A doctor bed is provided for holding a circularly cylindrical metering rod, including a housing of a homogenous material, which is designed with a cross section at right angles to the cylinder longitudinal axis of the metering rod and has a circularly cylindrical recess which surrounds the metering rod with a form fit over at least 180°. The doctor bed is arranged on a machine processing a moving material web, there being arranged on the housing, in the region of the recess, at least one groove running parallel to the cylinder longitudinal axis of the metering rod. A wiping strip is arranged detachably between the metering rod and the doctor bed.

11 Claims, 5 Drawing Sheets

DOCTOR BED

BACKGROUND OF THE INVENTION

1. Field of the Invention

The present invention relates to a doctor bed for holding a circularly cylindrical metering rod.

2. Description of the Related Art.

A known process for finishing material webs, in particular of paper, board, film or combinations of these materials, provides for the application of a liquid or pasty coating material, directly or indirectly via a transfer element, for example a roll, to the material web on a machine processing a moving material web. The coating material has to be metered and/or distributed uniformly onto the material web (brought to the desired coat weight) over the width of the latter or the transfer element. A very good quality of such finishing is achieved if the metering and/or distribution of the coating material is carried out by way of a circularly cylindrical metering rod rotating counter to the running direction of the material web or the transfer element to which the coating material is initially applied. The rotating metering rod may be enclosed by a doctor bed in the region which is not in contact with the material web or the transfer element. The doctor bed being used, in addition to mounting the metering rod, services to doctor off the coating material from the metering rod into the doctor bed at the entry edge, as viewed in the direction of rotation. As a result, the surface of the metering rod is cleaned of any crumbs, fibers, lumps and the like before the coating material sweeps over it. Because of the dual function of the doctor bed, firstly the mounting of the metering rod and secondly its permanent cleaning, its period of use is highly restricted. What is needed is an improvement in the durability with constant quality of the cleaning of the metering rod with, at the same time, constant quality of the mounting of the metering rod, which would result in a sharp reduction in the costs of production of material webs finished by a coating.

A known doctor bed currently has a housing made of a homogenous material, which is designed in one piece in its cross section at right angles to the cylinder longitudinal axis of the metering rod and which has a circularly cylindrical recess. The recess surrounds the metering rod by at least 180° with a form fit, in which recess the metering road is mounted in a press fit. In this case, in the transverse direction of the material web, parts belonging to the doctor bed, such as a dam or connecting devices for washing the metering rod can be arranged on the one-piece housing. A housing of this type consists, for example, of Polyethylene (PE), Polyurethane (PU) or rubber, the entry and exit edge consisting of the same material as the rotating metering rod. The press fit between the metering rod and the housing ensures, reliable mounting of the metering rod in the housing, and also reliable doctoring of the coating material off the metering rod and the prevention of leaks between a washing channel running parallel to the cylinder longitudinal axis of the metering rod and the region in which there is coating material. A disadvantage of this approach is that the press fit needs a high amount of drive power from the motor to drive the metering rod and there is rapid wear of the doctor bed.

International Patent Application WO 97/04172 A1 discloses a doctor bed including a housing assembled from a plurality of parts surrounding a recess for holding a circularly cylindrical metering rod, with contact elements arranged thereon and projecting into the recess in order to hold the metering rod. The contact elements are designed to be displaceable in the direction of the metering rod, in order to maintain a seal between the contact elements and the metering rod during progressive wear of the rod doctor. The seal is maintained by readjusting the contact elements by way of setting screws and spring loading.

The disadvantages with this doctor bed include firstly, the many individual parts of the housing cause its construction to be complicated, which entails the risk of faulty installation during assembly and reduced operational reliability because of the detachable connections between the individual parts of the housing. Secondly, the fine adjustment of the mounting of the metering rod, by way of screws, cause there to be a great deal of effort when adjusting the doctor bed during installation, servicing and maintenance of a machine for processing a moving material web. Additionally, there is the risk of an inaccurate setting of the mounting of the metering rod, causing stresses, and the loosening of the setting during operation. A stoppage of the machine caused by adjustment work results in enormous costs, since production has to be stopped for this purpose.

What is needed in the art is a doctor bed for holding a metering rod, which permits reliable mounting of the metering rod; reliable doctoring of the coating material off of the metering rod; simple and rapid installation on a machine treating a moving material web; and also simple servicing and maintenance.

SUMMARY OF THE INVENTION

According to the present invention, a doctor bed is provided for holding a circularly cylindrical metering rod, including a housing of a homogenous material, which is designed with a cross section at right angles to the cylinder longitudinal axis of the metering rod and has a circularly cylindrical recess which surrounds the metering rod with a form fit over at least 180°. The doctor bed is arranged on a machine processing a moving material web, there being arranged on the housing, in the region of the recess, at least one groove running parallel to the cylinder longitudinal axis of the metering rod. A wiping strip is arranged detachably between the metering rod and the doctor bed.

As compared with the prior art, the invention has the advantage that, by way of the at least one groove, arranged on the housing in the region of the recess and running parallel to the cylinder longitudinal axis of the metering rod, and the wiping strip which can be arranged detachably therein between the metering rod and the doctor bed. It is possible to mount the metering rod in a known, reliable manner in a single-piece housing produced from a homogenous material. This arrangement improves the period of use of the doctor bed and the quality of the coating to be applied with the aid of the doctor bed by using a material for the wiping strip, which is more resistant to wear and damage as compared with the material for the housing. The period of use of the doctor bed, preferably designed in one piece, can be prolonged considerably by the wiping strip, arranged detachably in the groove, since replacement of the wiping strip, subjected most intensely to the wear, is possible. The length of the wiping strip corresponds at least to the width of the material web, but the wiping strip only has a small contact area with respect to the metering rod. The wiping blade touches the metering rod only over a small part of its periphery over its entire length, or at least over the width of the material web. The wiping strip can be installed in a particularly simple manner, since it neither impairs the quality of the mounting of the metering rod nor affects the uniformity of the application thickness of the coating material. During the installation of the wiping strip, it is simply a matter that the latter touches the metering rod over the entire width of the material web, so that reliable doctoring of the coating material off of the metering rod is ensured. In this way, installation, servicing and maintenance work can be carried out substantially more quickly than hitherto.

One advantageous refinement of the present invention provides for the groove to be arranged between the metering rod and the doctor bed, at least at the entry and/or exit edge or in their immediate vicinity. Alternatively or additionally, the arrangement can also be made upstream and/or downstream of an existing channel for the lubrication and washing of the doctor bed and the metering rod.

The lifetime of the doctor bed, which hitherto was restricted because of the high wear at the entry and exit edge, can be prolonged considerably by the wiping strip, which can be arranged in the groove between the metering rod and doctor bed at the entry and/or exit edge. The wiping strip can be produced from a material that is more resistant to abrasion. Furthermore, the replacement of the wiping strip, independently of the other parts of the doctor bed, is possible.

One advantageous refinement of the present invention provides for the doctor bed and the metering rod to be spaced apart from each other in the direction of rotation of the metering rod, upstream of the wiping strip arranged at the entry edge. This allows for the coating material, wiped off the metering rod by the wiping strip, to flow away in a vortex formed upstream of the wiping strip and can thus be distributed homogenously over the width of the material web.

Another advantageous refinement of the present invention includes a pressing apparatus for resiliently pressing the wiping strip against the metering rod. The pressing apparatus is arranged at the bottom of the groove between the housing and the wiping strip. The resilient pressing apparatus is arranged in the bottom of the groove over the entire length thereof, and can include, for example, a sponge rubber strip, a strip which is spring loaded in the direction of the metering rod by a plurality of compression springs that press against the side of the wiping strip facing away from the metering rod, or an elastic hose to which compressed air is applied and which, as a result, expands in the groove. The resilient pressing of the wiping strip against the metering rod ensures that the wiping of the coating material off the metering rod is of a high quality and is constant over a long time period.

Another advantageous refinement of the present invention provides for the wiping strip to consist of a material that can be deformed elastically, at least under compressive stress, while pressing the wiping strip resiliently against the metering rod. A material which is suitable for this purpose, for example, is a material mixture of rubber and graphite.

A particularly advantageous refinement of the present invention provides for the wiping strip to consist of a dimensionally stable, abrasion-resistant material, which also has a low coefficient of friction with respect to the material of the metering rod. Such a material includes plastic, such as a polymer, such as polyurethane (PU) or polyamide (PA), a thermoplastic, such as polyethylene (PE), high molecular weight PE or polyester. The wiping strip can, furthermore, consist of a material which, for example, is used in sliding bearings and has emergency lubricating properties, such as bronze or a ceramic.

An additional advantageous refinement of the present invention provides for the wiping strip to touch the metering rod along exactly one line.

An advantageous refinement of the present invention provides for the wiping strip to taper to a point comparable with a doctor blade on its side facing the metering rod.

Another advantageous refinement of the present invention provides for the wiping strip to be replaceable independently of the metering rod and/or the doctor bed. The removal and installation of the wiping strip taking place laterally on the doctor bed, for example, by removing a dam or part thereof, arranged laterally on the doctor bed, and pushing the wiping strip into the groove from the side. The removal and installation can be carried out in a doctor bed arranged on the machine for processing a moving material web.

An additional, advantageous refinement of the present invention provides for a washing channel, running parallel to the cylinder longitudinal axis of the metering rod and connected to the circularly cylindrical recess over its entire length, to be arranged in the doctor bed. At least one groove, for holding the wiping strip, is arranged upstream and downstream of the washing channel in the direction of rotation of the metering rod. Through the washing channel, a solvent, for the coating material provided to be applied to the material web and distributed uniformly in terms of its thickness over the width of the material web by the metering rod, can be conducted along part of the periphery of the metering rod in order to clean it. In order to prevent contact between the solvent and/or lubricant, and the coating material, a reliable seal must be ensured between the regions of the rotating metering rod that are connected to the various substances. The wiping strips, arranged upstream and/or downstream of the at least one washing channel, can be produced from a different material than the material of the housing. The material is resistant to abrasion and wear, permitting reliable sealing of these regions with respect to one another. In this way the doctor bed can be used over a longer time period, with a constant quality of the mounting and guidance of the metering rod in the preferably one-part housing, as compared with a multi-part housing.

The arrangement of the wiping strips beside the at least one washing channel can be carried out additionally or alternatively to that of at least one wiping strip, which is present alongside the at least one groove.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
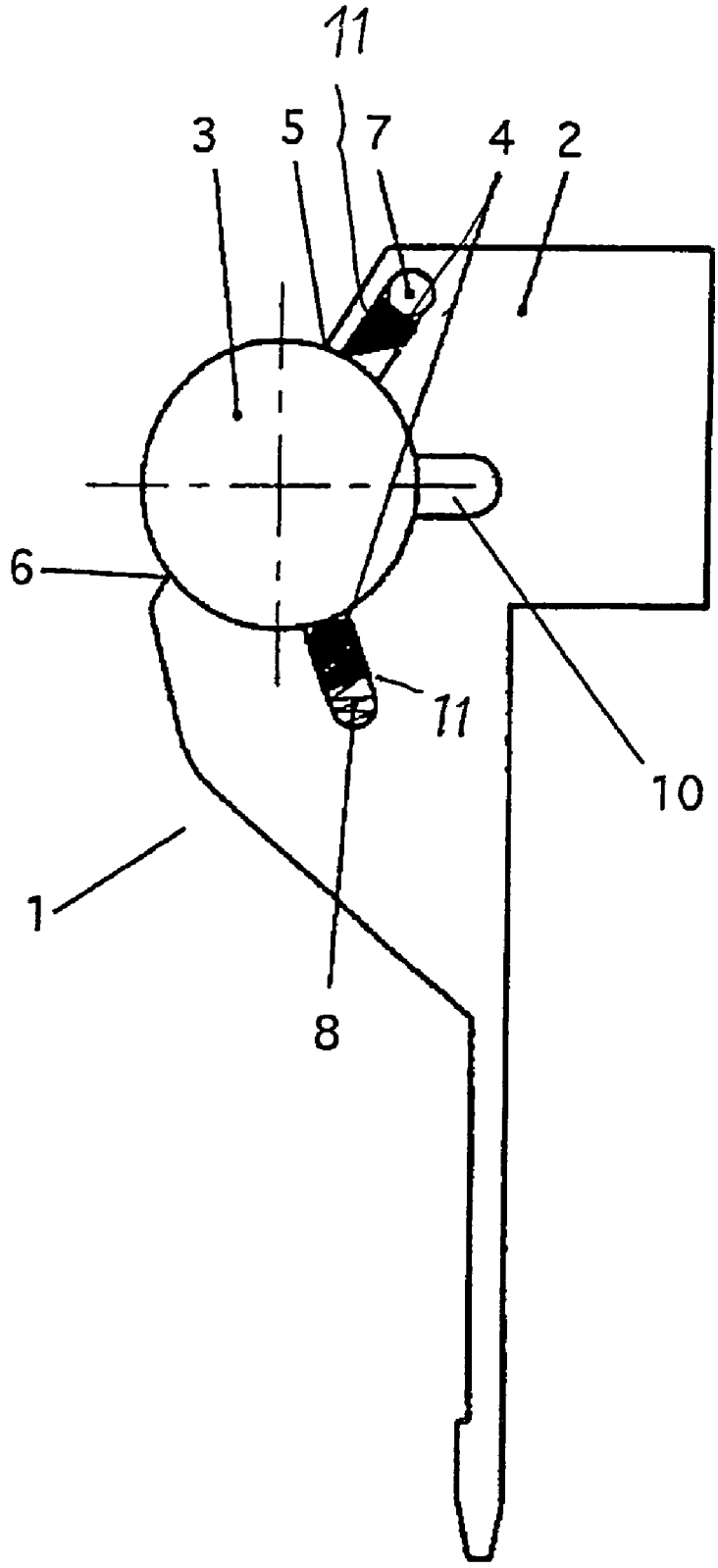
FIG. 1 shows a cross section through a doctor bed according to one embodiment of the present invention, at right angles to the cylinder longitudinal axis of a metering rod arranged in the doctor bed having two wiping strips arranged at an angle to each other.
Figure 2:
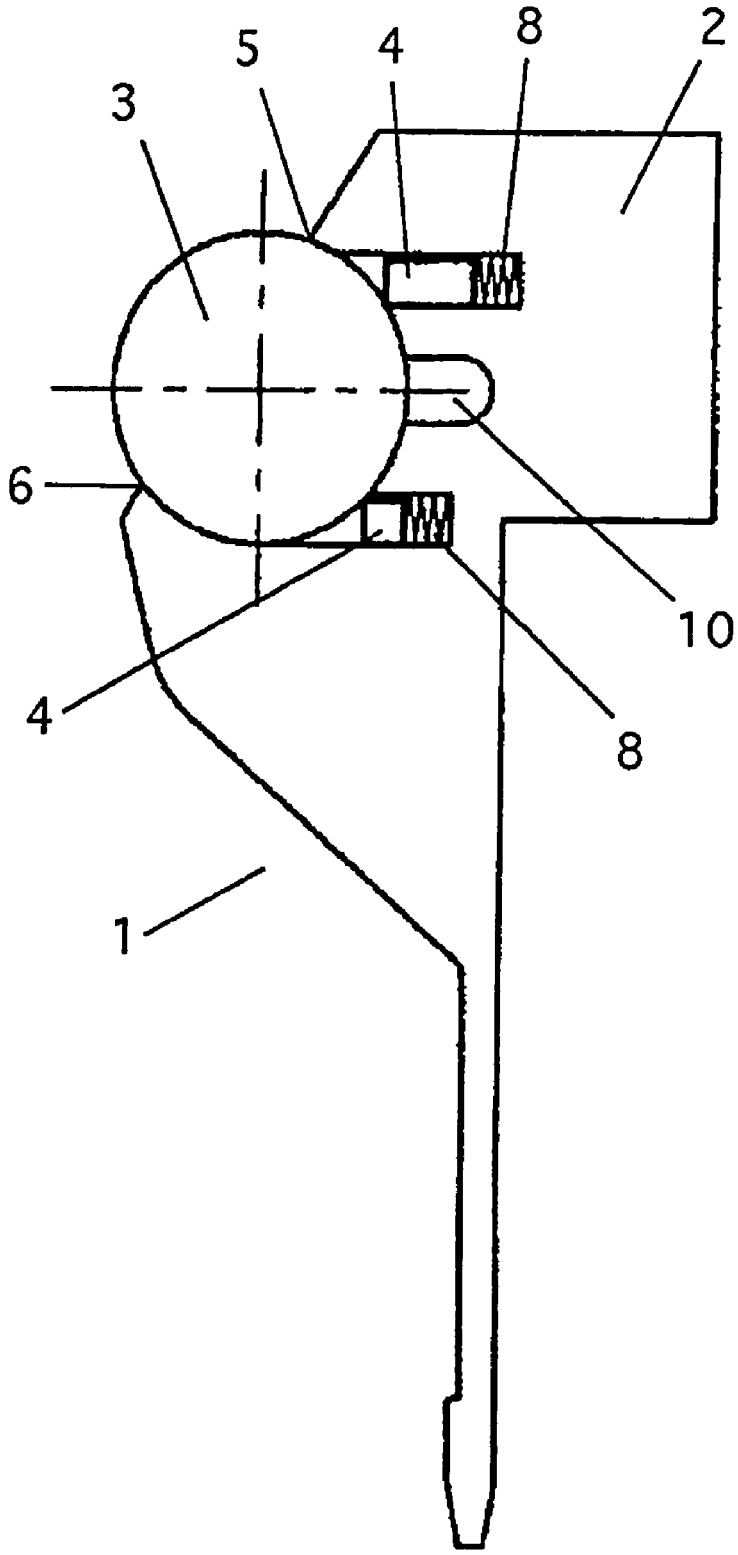
FIG. 2 shows a cross section through a doctor bed, according to another embodiment of the present invention, at right angles to the cylinder longitudinal axis of a metering rod arranged in the doctor bed, with two wiping strips arranged parallel to each other.
Figure 3:
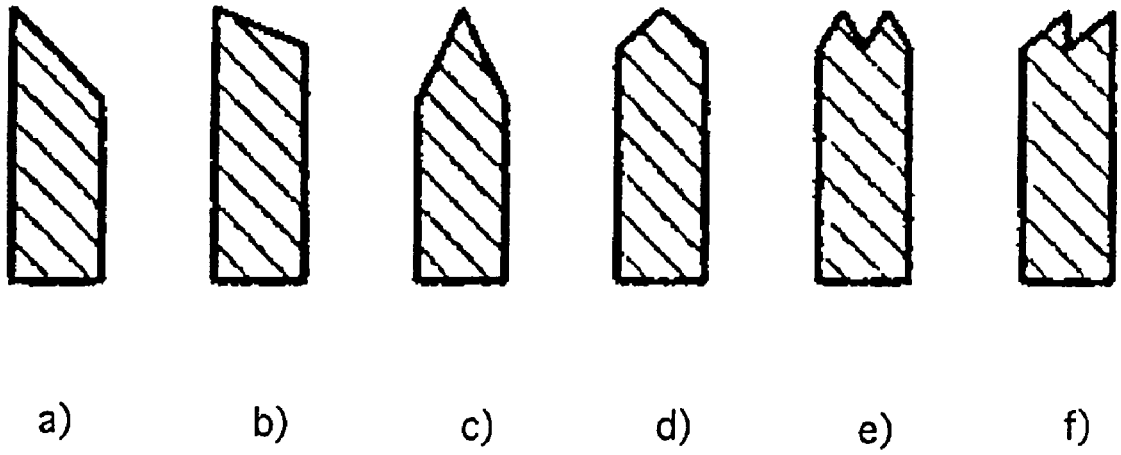
FIGS. 3 *a-f* show various blade shapes of wiping strips that can be arranged in the doctor beds of FIGS. 1 or 2.

A doctor bed 1 illustrated in FIGS. 1 and 2 include a housing 2, which has a circularly cylindrical recess for holding a circularly cylindrical metering rod 3. The recess encloses metering rod 3 by more than 180°, part of the periphery of metering rod 3 remaining exposed. Housing 2 is produced in one piece from a homogenous material, in the cross section it is illustrated as running at right angles to the cylinder longitudinal axis of metering rod 3. In order to reliably wipe off the coating material, that is to be distributed uniformly over the width of a moving material web, not illustrated, by metering rod 3 in housing 2, wiping strips 4 are arranged in grooves 11 running parallel to the cylinder longitudinal axis of metering rod 3. In FIG. 1, a wiping strip 4 is arranged directly at an entry edge 5 of doctor bed 1, a second wiping strip 4 is arranged at an angle to first wiping strip 4, and is arranged downstream in the direction of rotation of a washing channel 10 arranged on the outer periphery of metering rod 3, between the two wiping strips, and in contact with metering rod 3 over its length. In the case of doctor bed 1, illustrated in FIG. 2, two wiping strips are arranged parallel to each other, one on each side of washing channel 10. Wiping strips 4 touch metering rod 3 only along a line. This has the advantage that leaks between metering rod 3 and wiping strip 4, such as easily occur in the case of mutually touching, three-dimensionally shaped areas, can effectively be prevented. For this purpose, on their side facing metering rod 3, wiping strips 4 in each case have a suitable blade shape. Blade shapes of this type are illustrated in FIG. 3, in each case the upper side being the side of wiping strip 4 that faces metering rod 3. A pointed, asymmetrical blade is illustrated in FIG. 3*a*). FIG. 3 *b*) shows a somewhat more bluntly tapering, asymmetrical blade; FIG. 3*c*) shows a sharply tapering, symmetrical blade; and FIG. 3*d*) a symmetrical, bluntly tapering blade. FIG. 3*e*) shows a double blade having symmetrical individual blades, and FIG. 3*f*) shows a double blade with asymmetrically tapering individual blades.

Figure 4:
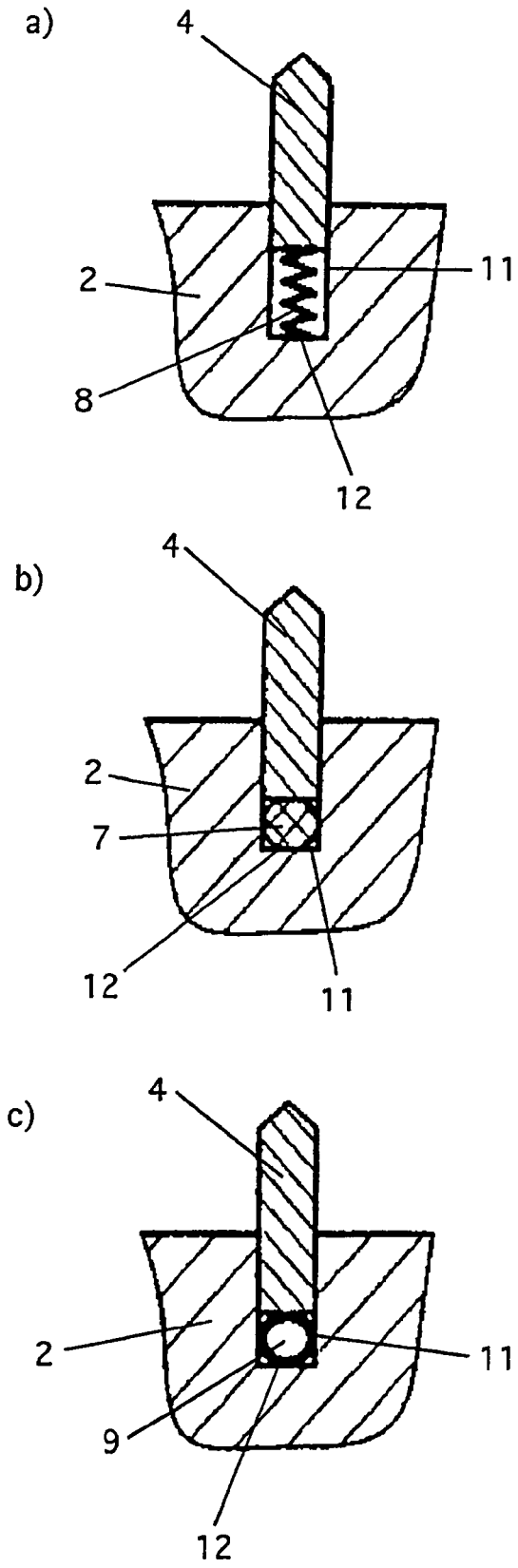
FIGS. 4 *a-c* show various cross-sectional views of pressing apparatuses for pressing strips arranged in a smooth groove in the housing of the doctor bed of FIGS. 1 or 2.
Figure 5:
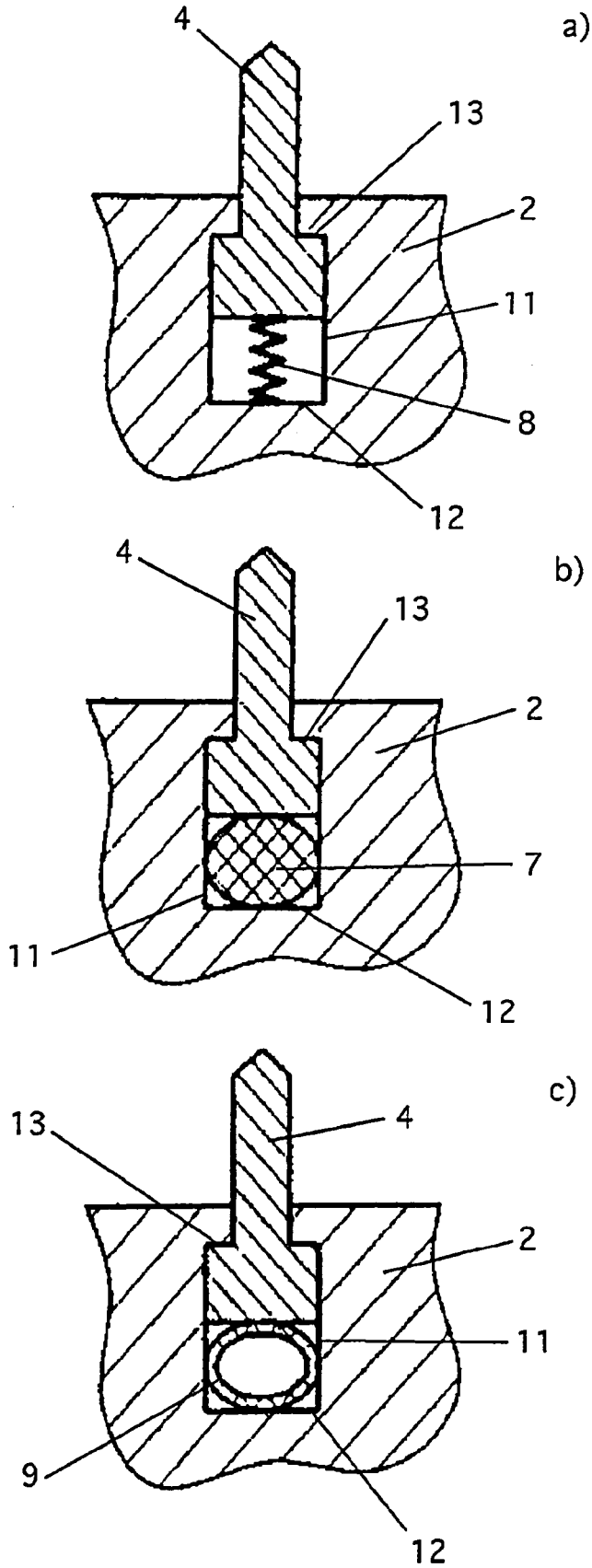
FIGS. 5 *a-c* show various cross-sectional views of pressing apparatuses for pressing strips arranged in a groove having an undercut in the housing of the doctor bed of FIGS. 1 or 2.

Wiping strips 4 are arranged in housing 2, as illustrated in FIGS. 4 and 5, spring-loaded in a groove 11 in each case. Here, groove 4 can be smooth, as illustrated FIG. 4, or, as illustrated in FIG. 5, can be designed with an undercut 13, by way of which wiping strip 4 is prevented from falling out of groove 11 during replacement of metering rod 3. In FIGS. 4*a*) and 5*a*), a wiping strip 4 is arranged in a groove 11, which is spring-loaded by way of a spring 8, which presses wiping strip 4 away from bottom 12 of groove 11. In FIGS. 4*b*) and 5*b*), instead of spring 8, sponge rubber 7, running over the entire length of groove 11, is arranged in groove 11, between bottom 12 of groove 11 and wiping strip 4. In FIGS. 4*c*) and 5*c*), sponge rubber 7 is replaced by a hose 9 that can be inflated with compressed air. Hose 9 can be inflated by being filled with compressed air, so that hose 9 occupies groove 11 in the region of bottom 12 and presses wiping strip 4 against metering rod 3, away from bottom 12.

It should be added that doctor bed 1 and housing 2, at least on entry side 5 of metering rod 3, can be set back by a distance "s", not illustrated in the figures, in order that the coating medium that is wiped off can be carried away unimpeded.

The invention can be applied commercially in particular in machines for producing and/or finishing paper, board or other fibrous webs.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

1 Doctor bed
2 Housing
3 Metering rod
4 Wiping strip
5 Entry edge
6 Exit edge
7 Sponge rubber
8 Spring
9 Hose
10 Washing channel
11 Groove
12 Bottom
13 Undercut

What is claimed is:

1. A doctor bed for holding a circularly cylindrical metering rod, comprising:

a housing of a homogenous material having a cross section at right angles to a cylinder longitudinal axis of the metering rod, said housing having a circularly cylindrical recess that surrounds the metering rod with a form fit of at least 180°, said recess having an entry edge and an exit edge, said housing having at least one groove in said recess running substantially parallel to said cylinder longitudinal axis of the metering rod;

at least one wiping strip detachably arranged between the metering rod and the doctor bed; and a washing channel that runs substantially parallel to said cylinder longitudinal axis of the metering rod, said washing channel connected to said circularly cylindrical recess over its entire length, said at least one groove including a first groove and a second groove, said at least one wiping strip including a first wiping strip and a second wiping strip, said first groove positioned upstream of said washing channel in a direction of rotation of the metering rod, said second groove positioned downstream of said washing channel in said direction of rotation, said first wiping strip being at least partially disposed in said first groove, said second wiping strip being at least partially disposed in said second groove.

2. The doctor bed of claim 1, wherein at least one said groove is arranged proximate to at least one of said entry edge and said exit edge between the metering rod and the doctor bed.

3. The doctor bed of claim 2, wherein the doctor bed and the metering rod are spaced apart from each other in a direction of rotation of the metering rod upstream of at least one said wiping strips arranged proximate to said entry edge.

4. The doctor bed of claim 1, further comprising a pressing apparatus resiliently pressing at least one of said wiping strips against the metering rod, said pressing apparatus being arranged at a bottom of at least one said groove between the housing and said at least one wiping strip.

5. The doctor bed of claim 1, wherein at least one of said wiping strips is made of a material that can be elastically deformed under at least compressive stress, thereby pressing said at least one said wiping strip resiliently against the metering rod.

6. The doctor bed of claim 1, wherein at least one of said wiping strips is made of a dimensionally stable, abrasion-resistant material having a low coefficient of friction with respect to the material of the metering rod, said abrasion-resistant material being at least one of a thermoplastic, a polymer, a ceramic and material mixtures being rubber mixed with at least one of graphite and a bearing metal.

7. The doctor bed of claim 6, wherein said bearing metal is bronze.

8. The doctor bed of claim 1, wherein at least one of said wiping strips touches the metering rod along exactly one line.

9. The doctor bed of claim 1, wherein at least one of said wiping strips tapers to a point on its side facing the metering rod.

10. The doctor bed of claim 1, wherein said at least one of wiping strips can be replaced independent of at least one of the meter rod and the doctor bed.

11. A doctor bed assembly, comprising:

a circularly cylindrical metering rod having a cylinder longitudinal axis;

a housing of a homogenous material having a cross section at fight angles to said cylinder longitudinal axis of said metering rod, said housing having a circularly cylindrical recess that surrounds said metering rod with a form fit of at least 180°, said recess having an entry edge and an exit edge, said housing having at least one groove in said recess running substantially parallel to said cylinder longitudinal axis of said metering rod;

at least one wiping strip detachably arranged between said metering rod and said housing; and a washing channel that runs substantially parallel to said cylinder longitudinal axis of the metering rod, said washing channel connected to said circularly cylindrical recess over its entire length, said at least one groove including a first groove and a second groove, said at least one wiping strip including a first wiping strip and a second wiping strip, said first groove positioned upstream of said washing channel in a direction of rotation of the metering rod, said second groove positioned downstream of said washing channel in said direction of rotation, said first wiping strip being at least partially disposed in said first groove, said second wiping strip being at least partially disposed in said second groove.

* * * * *

UNITED STATES PATENT AND TRADEMARK OFFICE

CERTIFICATE OF CORRECTION

PATENT NO. : 7,332,033 B2
APPLICATION NO. : 11/147118
DATED : February 19, 2008
INVENTOR(S) : Henninger et al.

It is certified that error appears in the above-identified patent and that said Letters Patent is hereby corrected as shown below:

COLUMN 7

At line 4, after “one” and before “said”, please insert --of--;
At line 13, after “one” and before “wiping”, please delete “said”;
At line 30, after “wherein” and before “at”, please delete “said”; and
At line 31, after “of” and before “wiping”, please insert --said--.

COLUMN 8

At line 5, please delete “fight”, and substitute therefore --right--.

Signed and Sealed this

Fourteenth Day of October, 2008

JON W. DUDAS
*Director of the United States Patent and Trademark Office*